US010043340B2

(12) United States Patent
Wright et al.

(10) Patent No.: US 10,043,340 B2
(45) Date of Patent: Aug. 7, 2018

(54) SYSTEM AND METHOD FOR IMPLEMENTING A PLURALITY OF GAMES

(71) Applicant: Paltronics Australasia Pty Limited, Taren Point, New South Wales (AU)

(72) Inventors: Dean Wright, New South Wales (AU); Stephen Cowan, New South Wales (AU)

(73) Assignee: Paltronics Australasia Pty Limited (AU)

( * ) Notice: Subject to any disclaimer, the term of this patent is extended or adjusted under 35 U.S.C. 154(b) by 127 days.

(21) Appl. No.: 14/643,259

(22) Filed: Mar. 10, 2015

(65) Prior Publication Data

US 2015/0317872 A1 Nov. 5, 2015

Related U.S. Application Data

(63) Continuation of application No. 11/908,922, filed as application No. PCT/AU2006/000351 on Mar. 16, 2006.

(30) Foreign Application Priority Data

Mar. 17, 2005 (AU) ..... 2005901326

(51) Int. Cl.
*G07F 17/34* (2006.01)
*G07F 17/32* (2006.01)
*A63F 9/24* (2006.01)

(52) U.S. Cl.
CPC ..... *G07F 17/3234* (2013.01); *A63F 9/24* (2013.01); *G07F 17/32* (2013.01);
(Continued)

(58) Field of Classification Search
CPC ..... G07F 17/3234
See application file for complete search history.

(56) References Cited

U.S. PATENT DOCUMENTS 5,116,055 A * 5/1992 Tracy ..... G07F 5/18 273/143 R
6,648,762 B2 11/2003 Walker et al.
(Continued)

FOREIGN PATENT DOCUMENTS

GB 2 201 279 A 8/1988
JP 10-127909 A 5/1998
(Continued)

OTHER PUBLICATIONS

Australian Patent Office ISA/AU. International Search Report dated Jun. 9, 2006. International Application No. PCT/AU2006/000351 filed on Mar. 16, 2006. Form PCT/ISA/210. English Language. 5 pages.

(Continued)

*Primary Examiner* — Jay Liddle
(74) *Attorney, Agent, or Firm* — Sterne, Kessler, Goldstein & Fox P.L.L.C.

(57) ABSTRACT

The gaming machine (1) includes a processor (4) with associated memory (5) implementing one of the games, a communications bus (6), a game display (7) for displaying information related to the progress of the game, a game identification display (8) for displaying an image—forming part of the game's resource data set—to allow a potential user to identify the game presently being provided as well as game specific information such as payouts, rules and so on, and a user interface device (9) as user-operable buttons. An output device (10) outputs to the central controller (2) machine performance messages (11) containing machine performance information as time since last play, total drop, total drop over a period of time, total return to player, return to player over a period of time, technical aspects of the gaming machine, and the like.

11 Claims, 3 Drawing Sheets

(52) U.S. Cl.
CPC ..... *G07F 17/3258* (2013.01); *G07F 17/3269* (2013.01); *G07F 17/3283* (2013.01)

(56) References Cited

U.S. PATENT DOCUMENTS

| | | | | |
|---|---|---|---|---|
| 7,883,417 | B2 | 2/2011 | Bruzzese et al. | |
| 7,918,736 | B2 * | 4/2011 | Walker ..... | G07F 17/32 463/20 |
| 2003/0181237 | A1 | 9/2003 | Olive | |
| 2004/0229698 | A1 | 11/2004 | Lind et al. | |
| 2006/0154723 | A1 | 7/2006 | Saffari et al. | |
| 2008/0113813 | A1 | 5/2008 | Wright et al. | |

FOREIGN PATENT DOCUMENTS

| | | | |
|---|---|---|---|
| JP | 2004-261498 | A | 9/2004 |
| JP | 2005-224424 | A | 8/2005 |
| JP | 2006-020864 | A | 1/2006 |
| WO | WO 96/12262 | | 4/1996 |
| WO | WO 2005/059848 | A1 | 6/2005 |

OTHER PUBLICATIONS

Australian Patent Office ISA/AU. PCT Written Opinion of the International Searching Authority dated Jun. 9, 2006. International Application No. PCT/AU2006/000351 filed on Mar. 16, 2006. Form PCT/ISA/237. English Language. 8 pages.

English-language abstract of Japanese Patent Application Publication No. 2005-224424 A, 2 pages.

English-language abstract of Japanese Patent Application Publication No. 2004-261498 A, 2 pages.

English-language abstract of Japanese Patent Application Publication No. 2006-020864 A, 2 pages.

English-language abstract of Japanese Patent Application Publication No. 10-127909 A, 2 pages.

* cited by examiner

SYSTEM AND METHOD FOR IMPLEMENTING A PLURALITY OF GAMES

CROSS-REFERENCE TO RELATED APPLICATIONS

This application is a continuation of U.S. patent application Ser. No.: 11/908,922, filed on Sep. 17, 2007, published as U.S. Patent Application Publication No.: 2015/0317872, now abandoned, which is a U.S. National Stage entry of International Patent Application No. PCT/AU2006/000351, filed on Mar. 16, 2006 which claims benefit of pending Australian Application No. 2005901326, filed on Mar. 17, 2005, each of which is incorporated herein by reference in its entirety.

FIELD OF THE INVENTION

The present invention relates to a system and method for implementing a plurality of games.

The invention has been developed primarily for use with a plurality of interlinked gaming machines in a gaming establishment and will be described with reference to this application. However, the invention is not limited to that particular field of use and is also suitable for use with online gaming, gaming machines that are distributed over a plurality of gaining establishments, lotto, pools, lotteries, art unions, bingo, raffles and other games involving one or more wagers being placed upon an outcome having a finite probability of occurring.

BACKGROUND

Any discussion of the prior art throughout the specification should in no way be considered as an admission that such prior art is widely known or forms part of common general knowledge in the field.

Networks of gaming machines are known, for example for the purpose of providing a level of linked gaming such as a linked jackpot. Generally the aim of such systems is to maintain user interest in the gaming machines. However, not all machines perform at the same level, in part due to some games being more popular than others. A low performing machine can slow the performance of the linked system, limiting the system's ability to retain player interest.

SUMMARY OF THE INVENTION

It is an object of the present invention to overcome or ameliorate at least one of the disadvantages of the prior art, or to provide a useful alternative.

Accordingly, a first aspect of the invention provides a system for implementing a plurality of games, including:

a gaming machine for implementing one of the plurality of games, and a central controller, the gaming machine including:

a processor for implementing a first one of the plurality of games;

an output device for outputting to the central controller a machine performance message containing machine performance information;

an input device for receiving a control message from the central controller; and a game-change device for causing the gaming machine to implement a second one of the plurality of games different from the first in dependence upon a received control message;

and the central controller including:

an input device for receiving the machine performance message from the gaming machine;

a processor for: extracting and processing the performance information; and selecting a desired game from the plurality of games in dependence upon the performance information; and an output device responsive to the processor for outputting the control message to the gaming machine for causing the machine to implement the desired game.

Preferably the machine performance messages contain information relating to the financial performance of the machine and the controller processor determines the desired game in dependence upon the financial performance information.

The central controller preferably collates historical performance information and the controller processor selects the desired game in dependence upon the historical performance information.

The system preferably further includes memory for storing for each of the plurality of games resource data for allowing the gaming machine to implement the game.

The gaming machine is preferably adapted to receive resource data from the memory in response to receipt of the control message.

Preferably, the resource data includes at least one of an executable program, audio and/or visual data and prize information.

The gaming machine preferably includes a game identification display for identifying the game presently being implemented by the machine by presentation of an image.

The system preferably includes a plurality of gaming machines, and the central controller is preferably adapted to receive machine performance messages from at least one of the machines and to output control messages to at least one of the machines.

Preferably, the central controller processor selects the desired game in dependence upon the performance information received from each of the gaming machines.

The central controller processor preferably selects one or more machines to which to output the control message.

Preferably, the central controller processor is adapted to interrogate one or more machines to determine whether it is or they are in use before selecting it or them as the machine or machines to which to output the control message.

Preferably, the central controller processor is adapted to select the one or more machines to which to output the control message in dependence upon the performance information.

The central controller is preferably a linked jackpot controller.

A second aspect of the invention provides a method of controlling at least one gaming machine to implement a plurality of games including the steps of:

receiving from the machine a machine performance message containing machine performance information;

extracting and processing the performance information;

selecting a desired game of the plurality of games in dependence upon the performance information; and outputting a control message to the gaming machine for causing the machine to implement the desired game.

Preferably, the machine performance messages contain information relating to the financial performance of the machine and the desired game is determined in dependence upon the financial performance information.

The method preferably includes collating historical performance information and selecting the desired game in dependence upon the historical performance information.

Preferably, the method includes storing for each of the plurality of games resource data for allowing the gaming machine to implement the game.

The resource data preferably includes at least one of an executable program, audio and/or visual data and prize information.

The method preferably includes the step of receiving machine performance messages from a plurality of gaming machines.

Preferably, the desired game is selected in dependence upon the performance information received from the plurality of gaming machines.

The method preferably includes the step of selecting one or more machines to which to output the control message.

Preferably, the method includes the step of interrogating one or more machines to determine whether it is or they are in use before selecting it or them as the machine or machines to which to output the control message.

The method preferably includes selecting the one or more machines to which to output the control message in dependence upon the performance information.

A further aspect of the invention provides a gaming machine for use in a network of gaming machines for providing a plurality of games controlled by a central controller, the machine including:

a processor for implementing a game;

an output device for outputting to the central controller a machine performance message containing machine performance information;

an input device for receiving a control message from the central controller; and a game-change device for causing the gaming machine to implement a different game in dependence upon the received control message;

Yet a further aspect of the invention provides a gaming machine network controller for controlling a network of gaming machines for providing a plurality of games, the controller including:

an input device for receiving machine performance messages from the gaming machines;

a processor for: extracting and processing the performance information; and selecting a desired game from the plurality of games in dependence upon the performance information; and an output device responsive to the processor for outputting a control message to at least one of the gaming machines for causing the machine to implement the desired game.

A further aspect of the invention provides a controller for controlling a gaming machine including:

a version checking device for checking whether a version of a resource, for example firmware, located at the gaming machine is the latest version of that resource; and an output device responsive to the version checking device for outputting to the gaming machine a control message for causing the gaining machine to retrieve the latest version of the resource.

Preferably the version checking device checks whether the version of a resource located at the gaming machine is the latest version of that resource with reference to a table indicating the version of the resource located at the machine.

Preferably the version checking device checks whether the version of a resource located at the gaming machine is the latest version of that resource by interrogating the machine.

Yet a further aspect of the invention provides a method for upgrading a gaming machine including the steps of:

at a central controller checking whether a version of a resource, for example firmware, located at the gaming machine is the latest version of that resource;

if the resource is not the latest version of that resource, at the central controller outputting a control message to the gaming machine;

at the gaming machine responding to a received control message by retrieving the latest version of the resource.

Preferably the central controller checks whether the version of a resource located at the gaming machine is the latest version of that resource with reference to a table indicating the version of the resource located at the machine.

Alternatively the central controller checks whether the version of a resource located at the gaining machine is the latest version of that resource by interrogating the machine.

Yet another aspect of the invention provides a system for communication of resource data, said system including:

a central controller in communication with a plurality of gaming machines, said central controller being adapted to implement a preselected secondary game selected from a plurality of secondary games, each of said gaming machines including:

a gaming device processor for using said resource data to implement any one of a plurality of primary games;

an input device for receiving resource data from the central controller; and storage means for storage of said resource data;

said central controller including:

a correlator for correlating each of said plurality of secondary games with respective sets of compatible primary games;

a central controller processor for determining said preselected secondary game and for using said correlator to select a desired set of primary games in dependence upon the preselected secondary game; and an output device responsive to the central controller processor for outputting resource data associated with said desired set of primary games to at least one of said gaming machines.

A further aspect of the invention provides a method for communication of resource data, said method including the following steps performed by a central controller in communication with a plurality of gaming machines:

determining a currently implemented secondary game from amongst a plurality of possible secondary games;

correlating said currently implemented secondary game with a set of compatible primary games; and communicating resource data associated with said desired set of primary games to at least one of said gaming machines.

Further aspects of the invention include a computer program for causing a computer to execute a method as set out above, and such a computer program carried by a data carrier or a signal.

BRIEF DESCRIPTION OF THE DRAWINGS

Preferred embodiments of the invention will now be described, by way of example only, with reference to the accompanying drawings, in which.

DETAILED DESCRIPTION

Figure 1:
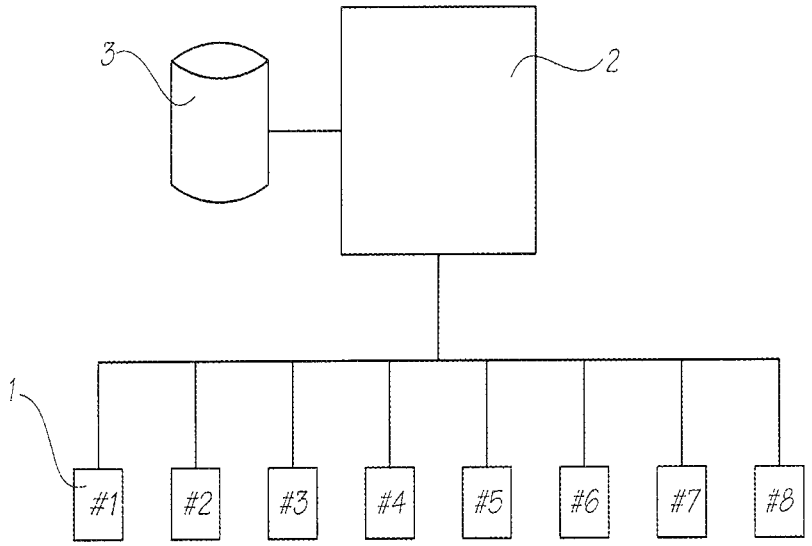
FIG. 1 is a schematic overview of a system for providing a plurality of games, including a plurality of gaming machines and a central controller.

Referring to FIG. 1, there is illustrated a system for implementing a plurality of games, including a plurality of gaming machines 1, a central controller 2 and memory in the form of a mass storage device 3.

For each of the plurality of games, say A, B, C and D, the mass storage device 3 stores respective resource data sets for allowing the gaming machines 1 to implement the games. The resource data sets include program data for allowing the gaming machines to implement the associated game, and audiovisual data for allowing the machines to display images and play sounds. The resource data sets also include prize information in the form of payout matrices, for example.

Figure 2:
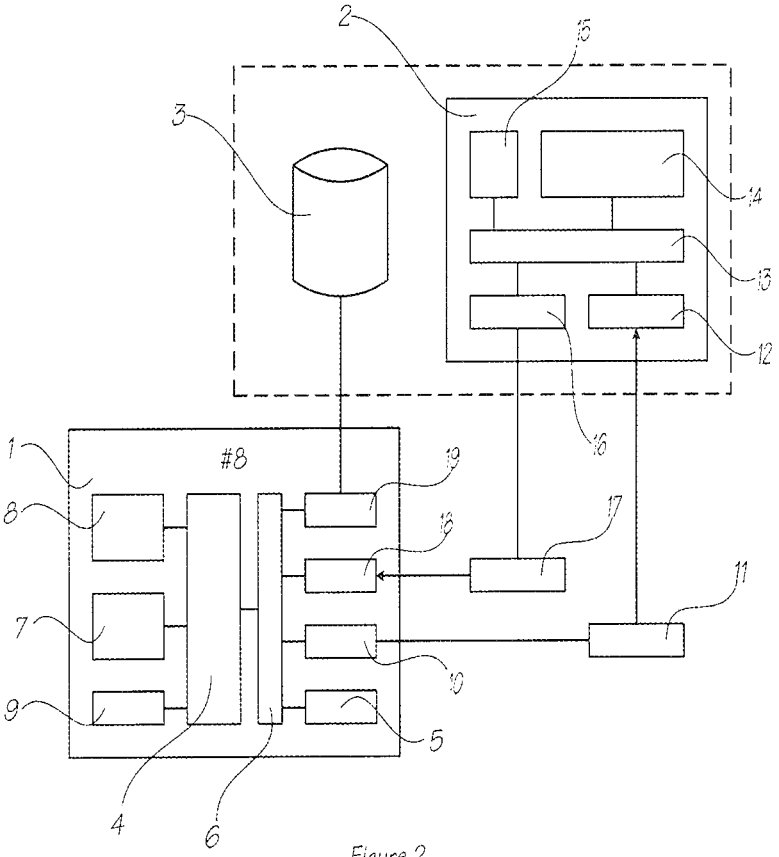
FIG. 2 is a more detailed schematic diagram of a gaming machine and the controller of FIG. 1.

FIG. 2 shows a single gaming machine 1 and the central controller 2 in more detail. The mass storage device 3 is collocated with the controller 2 but the gaming machines access it directly. In other embodiments, access to the mass storage device by the machines occurs via, and under the control of, the controller 2. In yet further embodiments, each gaming machine 1 has a local mass storage device which stores the resource data sets for the available games. More particularly, in the latter case, each of the gaming machines 1 includes an interface card having a local mass storage device 5 upon which the resource data for each of the available games is stored.

Returning to the embodiment shown in FIG. 2, the gaming machine 1 includes a processor 4 with associated memory 5 for implementing one of the games, a communications bus 6, a game display 7 for displaying information related to the progress of the game, a game identification display 8 for displaying an image-forming part of the game's resource data set—to allow a potential user to identify the game presently being provided as well as game specific information such as payouts, rules and so on, and a user interface device 9 such as user-operable buttons. An output device 10 outputs to the central controller 2 machine performance messages 11 containing machine performance information such as time since last play, for example. In a particularly preferred embodiment, the machine performance information also includes information relating to the financial performance of the machine 1, such as total drop, total drop over a period of time, total return to player, return to player over a period of time, and the like.

The central controller 2 includes an input device 12 for receiving machine performance messages 11 from the gaming machines 1. Via a communications bus 13, a controller processor 14 extracts and processes the performance information included in the machine performance messages 11. In a preferred embodiment, the controller 2 has local memory 15 in which it stores extracted information on an ongoing basis so that historical analysis may be performed.

In dependence upon the information extracted from the machine performance messages, including stored performance information, the processor 14 selects a desired game from the plurality of games and at least one target gaming machine 1 to implement the game; examples of the way in which the desired game and target machines are selected are provided below.

An output device 16 is responsive to the processor for outputting a control message 17 to the selected gaming machine 1 or machines for causing them to implement the desired game.

The gaming machines 1 further include respective input devices 18 for receiving control messages 17 from the central controller 2. In response to a received control message 17, a game-change device 19 causes the gaming machine to implement the desired game. For example, if machine #8, while implementing game A, receives a control message 17 identifying game B as the desired game, the game-change device 19 of machine #8 downloads the resource data associated with game B from the mass storage device 3 and replaces the resource data for game A stored in memory 5 with the downloaded resource data for game B.

As used in this document, any references to a "game" played on a "gaining machine" includes not only a primary game implemented on the gaming machine, but also any auxiliary or tertiary games that may be implemented on or in association with the gaming machine.

The game-change device 19 is configured to operate differently for those embodiments in which the resource data for all available games is stored on a local mass storage device 5 on the interface card of each gaming machine 1. In such cases, upon receipt of a control message 17, there is no requirement for the gaming, machine 1 to download resource data associated with the desired game from the central controller 2. Rather, the resource data is already stored locally at the gaming machine 1 and hence the gaming machine 1 has the information required to implement the desired game. Hence, this embodiment minimizes the requirement for high bandwidth communication of resource data between the central controller 2 and the gaming machines 1. Once the necessary resource data has been stored locally at each of the gaming, machines, the typical further routine communications between the controller 2 and the gaming machines 1 are communication of performance messages 11 from the gaming machines 1 to the central controller 2 and communication of control messages from the central controller 2 to the gaming machines. The amount of data in a typical performance message 11 and a typical control message 17 is very much smaller than the amount of resource data associated with a typical game. Hence, this embodiment advantageously substantially reduces the bandwidth requirements of the communications network through which the controller 2 communicates with the gaming machine 1.

The resource data includes images identifying the new game, instructions and rules for the new game and prize lists indicating the payouts for the new game, which are displayed on the game identification display 8, which is a display of a known type such as a CRT or LCD screen.

In another embodiment of the invention the machine performance information relates to a technical aspect of the gaming machine 1 from which the message 11 issues. The machine performance information may relate to any one or more of gaming machine type; gaming machine style; gaming machine manufacturer; gaming machine shell software type; and the like. This allows the central controller to determine a desired game for implementation on the gaming machine 1 based upon the communicated technical aspect. For example, Gaming Machine #4 may issue a machine performance message 11 indicating that the manufacturer of Gaming Machine #4 is Party X. This information is then analysed by the central controller, which refers data in the form of look-up tables to determine that Game C is best suited for implementation on a gaming machine manufactured by Party X. Hence, the central controller 2 issues a control message 17 instructing Gaming Machine #4 to implement Game C.

The operation of the system will now be described broadly with reference to FIG. 3, and then in further detail, including examples of specific embodiments and methods for determining the desired game and the target machine or machines.

Figure 3:
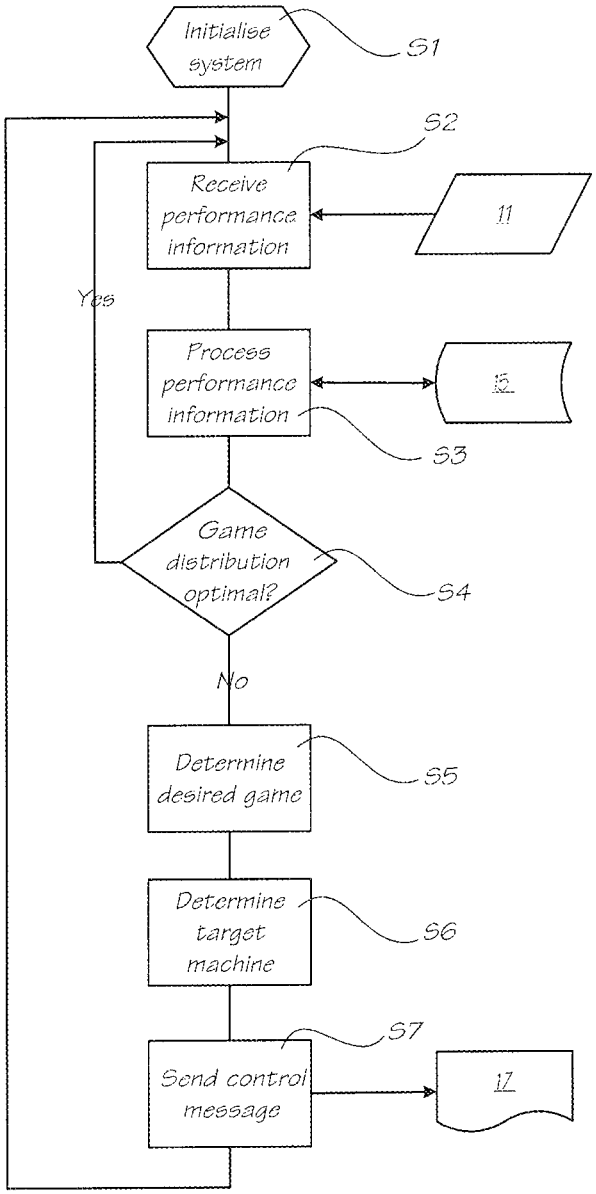
FIG. 3 is a flowchart showing the steps of a method of controlling a gaming machine.

Turning to FIG. 3, the central controller 2 initialises the system at step S1 by causing the plurality of gaming machines 1 to provide games selected according to an initially preferred distribution. During operation of the gaming machines, the controller receives the performance messages 11 at step S2. The information from the messages is extracted and collated at step S3. By analysis of the performance information extracted from the messages and any accumulated performance information the controller then determines at step S4 a desired distribution according to predetermined characteristics. The controller then checks whether the distribution of the games is optimal. If the distribution is optimal, the processor continues to receive and process performance messages. However, if the distribution is not optimal, at step S5 the controller determines a desired game which is under-represented. At step S6, the controller also determines a target machine, being a machine which is providing an over-represented game with reference to the desired distribution. At step S7, the controller sends a control message 17 to the machine to cause the machine to provide the desired game. For a short period beforehand, and whilst in the process of changing games, an indication is provided to warn potential users of the gaining machine 1 that a game change is imminent. For example a message such as "Game-change in Process" is displayed on the display 8 to notify patrons that the machine is temporarily unavailable. This assists to minimize the potential for confusion if a gamer were to choose to play a game immediately prior to the game being changed.

As shown in FIG. 1, eight gaming machines, #1 . . . #8, are linked to a central controller 2. In this embodiment, the central controller 2 is a linked jackpot controller which manages a linked jackpot system in a known manner by incrementing a jackpot prize pool in dependence upon messages received from the gaming machines 1 which indicate the value of wagers placed on the games. The messages pass from the gaming machines 1 in a known manner—for example, in one embodiment, the controller 2 polls each machine 1 periodically for messages. To enable the controller 2 to identify which machine is entitled to the jackpot prize, the message includes machine identification information (for example, an EPROM identifier).

In addition to using the information from the messages to administer the jackpot, the central controller 2 maintains tables of information including the date, time and value of wagers placed on the various machines 1 and the particular game that was being provided by the machine 1 at the time the wager was placed.

In one embodiment, the controller 2 analyses the table periodically and selects the desired game and target machine 1. For example, at the time of one analysis, the table of performance information indicates that within the preceding analysis interval of one hour, the following number of credits have been wagered on the various machines 1 which are presently providing the games noted. The final column indicates whether, when last polled, the machine had a nil credit meter (1 indicating that there were no funds available for payout or wagering, suggesting that the machine is not presently in use):

| Machine | Game | Credits | Nil credit |
|---|---|---|---|
| #1 | A | 100 | 1 |
| #2 | B | 200 | 0 |
| #3 | C | 400 | 0 |
| #4 | A | 400 | 0 |
| #5 | C | 500 | 0 |
| #6 | D | 400 | 0 |
| #7 | D | 100 | 1 |
| #8 | A | 200 | 1 |

From this information, the controller 2 determines the following average turnovers by game in the preceding analysis interval.

| Game | # machines | Total credits | Average credits |
|---|---|---|---|
| A | 3 | 700 | 233.33 |
| B | 1 | 200 | 200 |
| C | 2 | 900 | 450 |
| D | 2 | 500 | 250 |

Thus the games in descending order of popularity (as determined by average credits within an analysis period) are: C, D, A, B. Game C is therefore selected as the desired game.

When most recently polled, three machines (#1, #7 and #8) had no credits available for collection by a user or for wagering. These three machines 1 are therefore selected as the target machines.

In this embodiment, the controller 2 sends a control message 17 to each of machines #1, #7 and #8 identifying Game C as the target game.

While the analysis interval in the preceding example is one hour, other embodiments use different intervals according to preference.

In another embodiment, different desired numbers or proportions of machines 1 are determined for each game. For example it may be desired that one machine provides each of the two least popular games, two machines provide the second most popular game and the remaining four machines provide the most popular same. The target machine or machines and the desired game are then selected to achieve these numbers. In this way, it is possible to ensure that all games remain available to players so that data continues to be collected relating to all games.

In further embodiments, other data is used to select the desired game. For example, the actual return to player (RTP) or time-weighted total drop or return to player (weighted to emphasise more recent activity) are all used in various combinations in different embodiments.

In further embodiments, the controller 2 uses the data to determine trends and the desired game is selected as a result of this analysis. For example the rate of change of various characteristics, such as RTP and drop, are used in some embodiments. In other embodiments, trends such as the popularity of the various games at different times of day or days of the week are used to select the desired game.

In some embodiments the controller 2 analyses data from a sub-set of the gaming machines to determine whether the game distribution is optimal within that sub-set. The sub-sets may be defined in any manner as required by the operators of the system, for example they may be based upon individual gaming venues, geographical regions, market segments, and the like.

In some embodiments, the target machine is actually a class of machines. For example, the desired outcome is that one machine presently providing Game A be changed so that it provides Game B. In this embodiment, the controller 2 sends a suspend message to the candidate machines (all machines playing Game A). Machines 1 which receive a suspend message while they are in use ignore the message. However, machines which receive a suspend message while not in use return a confirmation message and take themselves out of operation. The controller 2 selects a machine 1 from among the machines which returned a confirmation message. A control message 17 is sent to that machine and release messages are sent to the other suspended machines, which respond by reactivating themselves. In another embodiment, machines 1 receiving a suspend message notify the controller 2 once they cease to be used by a user (for example when a certain period has elapsed without credit having been available on the machine). At the same time, the machine 1 suspends its operation and the controller 2 returns a control message to that machine and release messages to the other machines of the class.

In yet further embodiments, direct account is taken of the desires of a player. The user interface device 9 includes buttons for allowing the user to specify a desired game. When such an input device is operated, the machine 1 notifies the controller 2, which returns a control message 17. This may be advantageous for example when two players wish to use adjacent machines 1. In such embodiments, the central controller 2 is responsible for selecting the desired default game to be displayed on a given gaming machine 1 whilst that gaming machine awaits the attraction of a new user.

In yet a further embodiment, the system is used to upgrade firmware or game versions available on the gaming machines 1. The controller 2 maintains a table of the firmware and game versions at the various gaming machines 1 and sends control signals 17 to appropriate machines when firmware or game version upgrades are available. The appropriate machines are determined by checking the table. In an alternative embodiment, appropriate machines are determined by interrogating the machines and requesting version numbers of resources. This functionality is particularly useful for situations in which a particular aspect of a certain game is to be updated. For example, if it is desired to update the graphics used in a particular game, then an updated version of that game with the new graphics is produced. This embodiment of the invention is then used to update the firmware on all gaming machines 1 on which the particular game is implemented.

In the preferred embodiment, the system is implemented in networks in which the gaming machines 1 are distributed among a number of locations. However other embodiments are implemented in local networks of gaming machines.

The system illustrated in FIG. 2 is configurable to provide a system for communication of resource data associated with a set of primary games from the central controller 2 to the gaming machines 1. Although only one gaming machine 1 is illustrated in FIG. 2, a typical preferred embodiment will include a plurality of gaming machines 1, each in communication with the central controller 2. The central controller 2 implements a preselected secondary game, which is selected from a plurality of possible secondary games. That is, whichever secondary game is currently being implemented by the central controller 2 is referred to herein as the "preselected secondary game". Typically, each of the possible secondary games will be variants of linked jackpot games, however other game types are implemented as secondary games in alternative embodiments.

Each of the gaming machines 1 includes a gaming device processor 4, which uses the resource data to implement any one of a plurality of primary games. In the preferred embodiment the primary games are poker machine games, although other types of games may be utilized in other embodiments. Each of the gaming machines 1 also includes an input device 18 for receiving resource data from the central controller 2. The gaming machines 1 further include a local storage device 5 for storage of the resource data. In the preferred embodiment the local storage device 5 is provided as part of the interface card.

The central controller 2 includes a correlator for correlating each of the plurality of secondary games with respective sets of compatible primary games. The correlator is provided by a suitably programmed central controller processor 14 interacting with data stored in the local memory 15 of the central controller 2. An exemplary embodiment features three secondary games, referred to as Secondary Game A, Secondary Game B and Secondary Game C, and supports ten primary games, referred to as Primary Game 1 through to Primary Game 10. The data is in the form of a look-up table having the following logic:

| Secondary Game | Associated Primary Games |
|---|---|
| Secondary Game A | Primary Games 2, 4, and 8 |
| Secondary Game B | Primary Games 1 and 10 |
| Secondary Game C | Primary Games 3, 5, 6, 7 and 9 |

Hence it follows that Secondary Game A is compatible with any one of Primary Games 2, 4 and 8. Secondary Game B is compatible with any one of Primary Games 1 and 10. Secondary Game C is compatible with any one of Primary Games 3, 5, 6, 7 and 9.

The central controller processor 14 determines the preselected secondary game. For the sake of the running example, assume that Secondary Game B is currently being implemented. This is determined by the processor 14, and the correlator is then used to select a desired set of primary games in dependence upon the preselected secondary game. In the running example, the set consisting of Primary Games 1 and 10 would be selected. The resource data associated with the desired set of compatible primary games is then communicated from the central controller 2, via an output device 16 to at least one of the gaming machines 1. In the running example, the resource data associated with Primary Games 1 and 10 is downloaded from the central controller 2 to at least one of the gaming machines 1.

This preferred embodiment streamlines and partially automates the process of installing a new network of linked gaming machines or the process of adding a new gaming machine 1 onto a pre-existing linked gaming network. The embodiment automatically downloads the resource data for only those primary games that are compatible with whichever secondary game is currently being implemented on the central controller 2. Additionally, this preferred embodiment streamlines and partially automates the process of switching between secondary games on the central controller 2. Once the central controller processor 14 determines that a new secondary game has been selected, the system downloads the resource data for those primary games that are compatible with the newly selected secondary game.

Although the invention has been described with reference to specific examples, it will be appreciated by those skilled in that art that it may be embodied in many other forms. In particular, features of any one of the various described examples may be provided in any combination in any of the other described examples.

In addition, the invention may be embodied in, or in combination with, the systems disclosed in our copending Australian patent application numbers 2004902460, 2004902465, 2004900978, 2004905519, 2004902469, 2004902459, 2004906409, 2005900239 and 2005905783 and International patent application numbers WO 2005/107913, WO 2005/107899, WO 2005/083599, WO 2005/107901, WO 2005/1079914, WO 2005/107912, WO 2005/008514 and WO 2005/042123, the entire contents of which are hereby incorporated by reference.

Furthermore, the functionality of various features of the machines 1 and the controller 2 have been described as being performed by distinct devices, such as dedicated integrated circuits. However, in preferred embodiments, all or any combination of their functionality may instead be performed by multi-purpose integrated circuits or implemented in software executed by the processors 4, 14. Particularly in such cases, the invention may additionally be embodied in a computer program or in a computer program in a data signal or stored on a data carrier.

What is claimed is:

1. A computer implemented method for managing a distribution of a plurality of games among a plurality of linked electronic gaming machines, each linked electronic gaming machine from among the plurality of linked electronic gaming machines contributing to a jackpot, the method including:

receiving, by a linked jackpot controller from the plurality of linked electronic gaming machines, a plurality of jackpot incrementing messages for altering the jackpot, each jackpot incrementing message from among the plurality of jackpot incrementing messages being indicative of;

an identifier that uniquely identifies a corresponding linked electronic gaming machine from among the plurality of linked electronic gaming machines, wherein the plurality of linked electronic gaming machines is configured to accept one or more wagers that enable operation of one or more games from among the plurality of games being provided by the plurality of linked electronic gaming machines; and value information for the one or more wagers placed at the corresponding linked electronic gaming machine;

processing, by the linked jackpot controller, the value information from each of the plurality of jackpot incrementing messages to increment a jackpot prize pool corresponding to the jackpot;

processing, by the linked jackpot controller, the value information from each of the plurality of jackpot incrementing messages to identify one of the plurality of games as being a most popular game during an analysis interval time period;

identifying, by the linked jackpot controller, a target machine from among the plurality of linked electronic gaming machines that is not currently implementing the most popular game; and instructing, by the linked jackpot controller, the target machine to implement the most popular game.

2. The method of claim 1, wherein the processing the value information from each of the plurality of jackpot incrementing messages to identify one of the plurality of games as being the most popular game comprises:

accessing a data table that includes the one or more games being provided by the plurality of linked electronic gaming machines, wherein a number of games from among the one or more games is less than a number of linked electronic gaming machines from among the plurality of linked electronic gaming machines; and combining the value information from each of the plurality of jackpot incrementing messages for each of the plurality of games to determine an average number of credits wagered during the analysis interval time period for each of the plurality of games.

3. The method of claim 2, wherein the processing the value information from each of the plurality of jackpot incrementing messages to identify one of the plurality of games as being the most popular game further comprises:

identifying the one of the plurality of games having a highest average number of credits wagered during the analysis interval time period as the most popular game.

4. The method of claim 1, wherein the identifying comprises:

determining whether there is nil credit available for credit by a user or for wagering for each linked electronic gaming machine of the plurality of linked electronic gaming machines, and identifying the target machine as being one of the plurality of linked electronic gaming machines having the nil credit available during the analysis interval time period.

5. The method of claim 1, further comprising:

processing the plurality of jackpot incrementing messages to update a data table that stores data, the data including:

identities of the plurality of linked electronic gaming machines;

the one or more games being provided the plurality of linked electronic gaming machines; and cumulative values of wagers placed at the plurality of linked electronic gaming machines.

6. The method of claim 1, further comprising:

ranking, by the linked jackpot controller, the plurality of games based on popularity during the analysis interval time period, and providing, by the linked jackpot controller, instructions to the plurality of linked electronic gaming machines to implement a popularity-based game distribution.

7. A linked jackpot controller for managing a jackpot, the linked jackpot controller comprising:

input circuitry configured to receive a plurality of jackpot incrementing messages for altering the jackpot from a plurality of linked electronic gaming machines, wherein the plurality of linked electronic gaming machines is linked to the linked jackpot controller and configured to communicate the plurality of jackpot incrementing messages to the linked jackpot controller, wherein each jackpot incrementing message from among the plurality of jackpot incrementing messages is indicative of:

an identifier that uniquely identifies a corresponding linked electronic gaming machine from among the plurality of linked electronic gaming machines, wherein the plurality of linked electronic gaming machines is configured to accept one or more wagers that enable operation of one or more games from among the plurality of games being provided by the plurality of linked electronic gaming machines; and value information for the one or more wagers placed at the corresponding linked electronic gaming machine; and a processor configured to:

process the value information from each of the plurality of jackpot incrementing messages to increment a jackpot prize pool corresponding to the jackpot, process the value information from each of the plurality of jackpot incrementing messages to identify one of the plurality of games as being a most popular game during an analysis interval time period, identify a target machine from among the plurality of linked electronic gaming machines that is not currently implementing the most popular game, and instruct the target machine to implement the most popular game.

8. The linked jackpot controller of claim 7, wherein the processor is configured to:

access a data table that includes the one or more games being provided by the plurality of linked electronic gaming machines, wherein a number games from among the one or more games is less than a number of linked electronic gaming machines from among the plurality of linked electronic gaming machines; and combine the value information from each of the plurality of jackpot incrementing messages for each of the plurality of games to determine an average number of credits wagered during the analysis interval time period for each of the plurality of games.

9. The linked jackpot controller of claim 8, wherein the processor is configured to identify the one of the plurality of games having a highest average number of credits wagered during the analysis interval time period as the most popular game.

10. The linked jackpot controller of claim 7, wherein the processor is configured to:

determine whether there is nil credit available for credit by a user or for wagering for each linked electronic gaming machine of the plurality of linked electronic gaming machines, and identify the target machine as being one of the plurality of linked electronic gaming machines having the nil credit available during the analysis interval time period.

11. The linked jackpot controller of claim 7, wherein the processor is further configured to:

process the plurality of jackpot incrementing messages to update a data table that stores data, the data including:

identities of the plurality of linked electronic gaming machines;

the one or more games being provided by the plurality of linked electronic gaming machines; and cumulative values of wagers placed at the plurality of linked electronic gaming machines.

* * * * *